United States Patent [19]

Reinhard

[11] 4,425,983

[45] Jan. 17, 1984

[54] FOLDING FIRE ESCAPE LADDER

[76] Inventor: Cheyenne A. Reinhard, 29372 Providence Way, Hayward, Calif. 94544

[21] Appl. No.: 310,108

[22] Filed: Oct. 9, 1981

[51] Int. Cl.[3] ..... E06C 9/12

[52] U.S. Cl. ..... 182/96; 182/160

[58] Field of Search ..... 182/95, 96, 159, 160

[56] References Cited

U.S. PATENT DOCUMENTS 2,299,584 10/1942 Low ..... 182/24

4,189,028 2/1980 Reinhard ..... 182/160

*Primary Examiner*—R. P. Machado

*Attorney, Agent, or Firm*—Lothrop and West

[57] ABSTRACT

The ladder of the invention includes first and second upright angle members connected together for movement in a parallel, arcuate relationship between an open position and a nested position. A cam surface on one of the uprights, when the uprights are going toward nested position, bears against a notched lever mechanism including a cap pivoted on the other one of said uprights. Normally, the lever mechanism is urged by a spring into latching position. The movement of the movable upright with respect to the other upright cams the cap and lever out of the way. The first and second uprights, when nested, are in a position with a flange on one of the uprights in a notch in the lever so that the uprights are contained in nested position. There is a pull cord for releasing the lever mechanism.

3 Claims, 5 Drawing Figures

FOLDING FIRE ESCAPE LADDER

BRIEF SUMMARY OF THE INVENTION

A folding fire escape ladder has a first L-shaped upright and a second L-shaped upright connected together for parallel swinging motion, one of the uprights being attached to a sustaining wall. There is a lever mechanism pivoted on one upright and including a lever with a hook and notch configuration adapted to engage the other upright when the uprights are in nested condition. The lever mechanism includes a cap engaged with the lever itself and overlying the uprights in nested position. The lever mechanism is pulled by a spring into a position with the notch in the lever mechanism in interengagement with a flange of the other upright member. There is a control cord connected to the end of the lever mechanism and to one of the uprights. A user, by deflecting the cord, can rotate the lever mechanism about its mounting on one of the uprights and so disengage the notch in the lever mechanism from the other upright. This releases the uprights for the indicated relative swinging motion. When the uprights are again approached, the lever mechanism is cammed by engagement of the cap and a rounded portion of the approaching upright to reengage the lever notch with the approaching upright.

DETAILED DESCRIPTION

This folding fire escape ladder is comparable in many respects to the folding fire escape ladder shown in my U.S. Pat. Nos. 3,575,263 issued Apr. 20, 1971 and 4,189,028 issued Feb. 19, 1980. The fundamental structure includes a first upright 6, generally of an angular shape in transverse cross-section and so having a pair of flanges, one transverse and one projecting. The first upright 6 is joined, usually through brackets or the like, to a wall or other vertical support so that the first upright is held stationary.

There is a second, similar upright 7 having its own flanges parallel to the flanges of the first upright and joined to the first upright by straps 20 or rungs pivoted at opposite ends to the uprights 6 and 7, as disclosed in the above-identified patents. In this way, the second upright is mounted for movement always parallel to the first upright and in an arcuate path so that the second, movable upright rises as its approaches the first, stationary upright.

Figure 1:
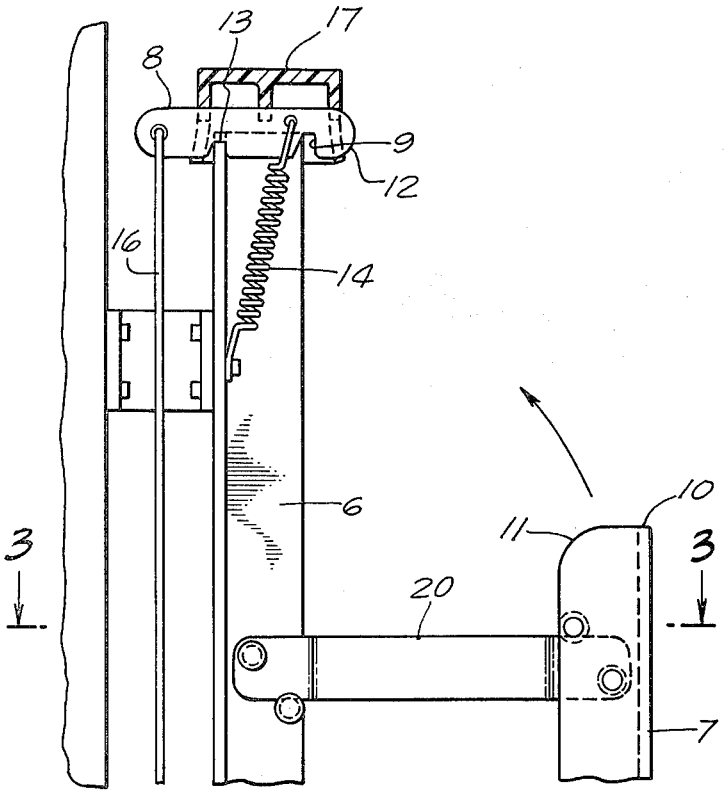
FIG. 1 is a side elevation, portions being in transverse cross-section, of the upper ends of upright members showing the lever mechanism pivotally mounted on one of the members and including a suitable cap for covering the top of the structure when nested.
Figure 2:
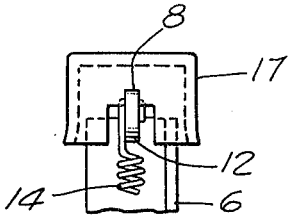
FIG. 2 is a side elevation of the upper portion of the structure of FIG. 1.

In order that the ladder portions 6 and 7 can be kept nested most of the time and until they are to be put into extended position for an emergency, there is afforded a lever mechanism 8 having a fulcrum connection 13 with one of the flanges of the first upright 6 (FIG. 1). A portion of the lever mechanism near one free end is provided with a notch 9 and with a rounded nose 12. A spring 14 engages the lever mechanism on the notch side of the fulcrum 13 and is anchored to the adjacent upright so that the lever mechanism is urged in a clockwise rotational direction as shown in FIG. 1.

Particularly pursuant to the invention, the lever mechanism includes or is crowned with a cap 17. This is preferably of plastic or light material of sufficient compass or area to cover the parts when nested. The cap is frictionally mounted on or is otherwise engaged with the rest of the lever mechanism 8 with a tight enough fit so that the cap 17 and the lever function together.

Particularly pursuant to the invention, the movable, second upright 7 has one of its flanges especially contoured to provide a cam 11. This is an edge surface on the outstanding or projecting flange of the upright. The cam is disposed in a position to come into physical contact with the lever mechanism 8 and particularly into physical contact with the edge of the cap 17 whenever the second upright 7 is moved toward nesting position with the first upright 6. As the uprights approach the nesting position, the cam 11 and an adjacent margin of the cap 17 or of the nose 12 come into abutment. This moves or cams the cap and lever mechanism around the pivot formed by the fulcrum 13 and against the urgency of the spring 14.

Figure 4:
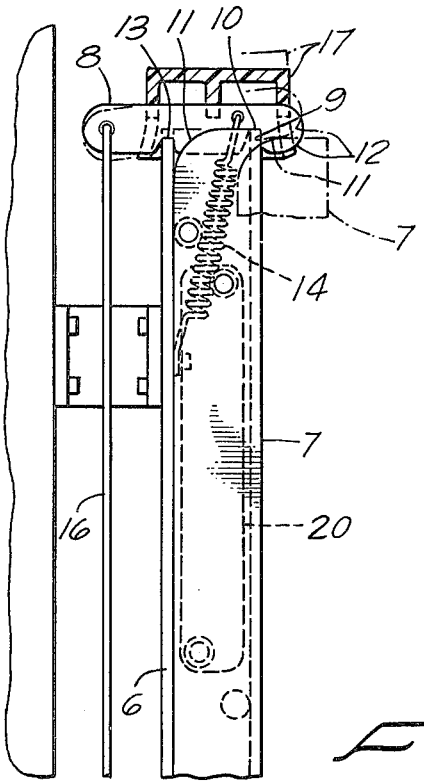
FIG. 4 is a view like FIG. 1 but with the structure in closed position.
Figure 3:
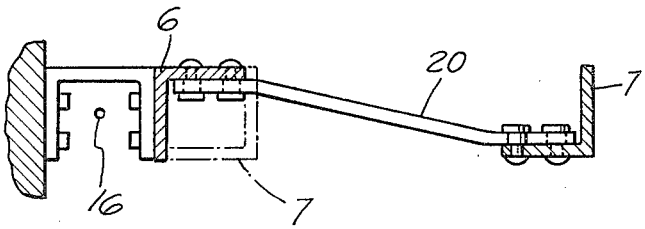
FIG. 3 is a cross-section, the plane of which is indicated by the line 3—3 of FIG. 1.

This camming operation lifts the lever-cap mechanism out of the way of the mutually approaching uprights, so that the uprights can move easily into nested position. As the second upright 7, as seen in FIG. 4, comes to rest in nested position with its own flange 10 substantially below the notch 9, the spring 14 is then effective to move the lever mechanism in a clockwise direction with the notch accommodating and receiving the flange 10, which is thereupon confined or blocked transversely between the walls of the notch.

The spring 14 and the lever notch 9 maintain the parts in this stowed or usual position. Under all normal conditions the first upright 6 and the second upright 7 are held in nested position and the ladder itself is then not extended. However, when use of the ladder is required, a pull cord 16 attached to the lever mechanism and to the related upright is pulled. The lever 8 is thus rotated, so lifting the lever notch 9 away from the previously retained flange. Under those circumstances the first and second uprights are released from each other. Its own weight and any additional weight on the movable, second upright causes that upright to swing in its arcuate, parallel path into a spaced position with respect to the first upright and disposes the ladder treads 20 or rungs horizontally. The ladder can then be used.

When the use is discontinued, the second upright 7 is manually moed toward its nested location. As nesting position is approached, the cam 11 on that upright bears against an approached portion of the lever mechanism and lifts the lever and cap against the urgency of the spring 14 and then releases them. The lever notch 9 again receives the flange of the movable upright, and the ladder is again latched indefinitely in nested condition.

Figure 5:
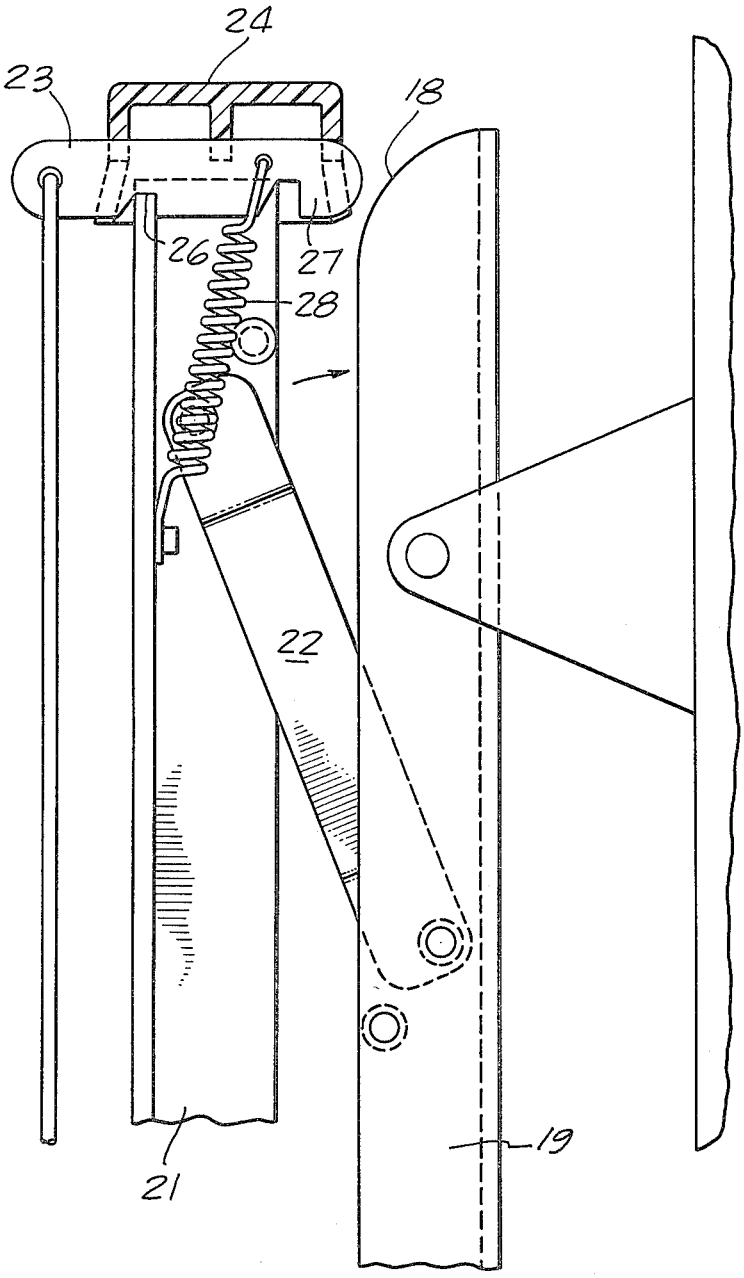
FIG. 5 is a view like FIG. 1 showing a modified form of construction.

A similar arrangement in FIG. 5 has a rounded cam surface 18 on a first, fixed upright 19. The upright 19 is fastened stationarily to a building. Joined for arcuate, parallel motion relative to the first upright 19 is a second movable upright 21. Junctions between uprights are effected by pivoted rungs 22. At the top of the movable upright 21 is a lever 23 and a cap 24 secured thereto. The lever 23 has a flange-engaging pivot notch 26 and a notched hook 27 with a rounded nose. A spring 28 urges the lever clockwise in FIG. 5. When the movable upright 21 approaches (and rises relative to) the fixed upright 19, the hook 27 or the edge of the cap 24 rubs against the cam surface 18, so that the uprights nest easily and the lever 23 engages the upright 19 and holds the angle uprights together until they are subsequently released by motion of the lever 23 counterclockwise. The uprights then separate by gravity, and the rungs 22 assume a horizontal position for use.

I claim:

1. A folding fire escape ladder adapted to be secured to a wall comprising a first upright L-shaped in transverse cross-section to provide a first projecting flange and a first transverse flange parallel to said wall; a second upright L-shaped in transverse cross-section to provide a second projecting flange parallel to and facing opposite to said first projecting flange and to provide a second transverse flange parallel to said first transverse flange; means for interconnecting said first and second uprights for arcuate motion relative to each other between a spaced, parallel position and a nested, parallel position; a lever mechanism including a lever disposed between and spaced from said first and second projecting flanges and having a hook and notch at one end thereof, said lever mechanism including a cap having an edge, said cap tightly engaging said lever for motion together therewith; means including a fulcrum connection for mounting of said lever mechanism on the transverse flange of one of said uprights to permit pivoting of the lever mechanism without longitudinal disengagement thereof from the transverse flange of said one of said uprights; a spring connected to said lever mechanism and to said one of said uprights for urging said hook and notch toward the transverse flange of the other one of said uprights; and means forming a cam on the projecting flange of the other one of said uprights adapted, when said uprights are moved relative toward each other, to engage against and below said edge of said cap to cam said cap upward and thereby move said lever mechanism against said spring to pass said other upright and to release said lever mechanism under force of said spring with said notch engaging the transverse flange of said other upright.

2. A device as in claim 1 including a cable attached to said lever mechanism for moving said lever against said spring to release said other transverse flange from said notch.

3. A device as in claim 1 in which said cap frictionally engages said lever with sufficient force to move said lever against said spring when said cap is engaged by said cam.

* * * * *